US008116059B2

(12) United States Patent
Critchley

(10) Patent No.: US 8,116,059 B2
(45) Date of Patent: Feb. 14, 2012

(54) SYSTEM AND METHOD FOR QUICKLY DISCHARGING AN AC RELAY

(75) Inventor: Malcolm J. Critchley, Scottsdale, AZ (US)

(73) Assignee: Leach International Corporation, Buena Park, CA (US)

( * ) Notice: Subject to any disclaimer, the term of this patent is extended or adjusted under 35 U.S.C. 154(b) by 106 days.

(21) Appl. No.: 12/431,682

(22) Filed: Apr. 28, 2009

(65) Prior Publication Data

US 2009/0284878 A1 Nov. 19, 2009

Related U.S. Application Data

(60) Provisional application No. 61/048,552, filed on Apr. 28, 2008.

(51) Int. Cl.

| | |
|---|---|
| ***H01H 9/00*** | (2006.01) |
| ***H01H 51/22*** | (2006.01) |
| *H01H 47/00* | (2006.01) |
| *H01H 47/32* | (2006.01) |

(52) U.S. Cl. ..... 361/160; 361/159

(58) Field of Classification Search ..... 361/159–160
See application file for complete search history.

(56) References Cited

U.S. PATENT DOCUMENTS 4,079,336 A 3/1978 Gross
4,224,654 A * 9/1980 Goldthorp et al. ..... 361/152
4,274,122 A 6/1981 Hansen et al.
4,649,286 A * 3/1987 Takeda et al. ..... 307/10.1
4,688,138 A * 8/1987 Nagata et al. ..... 361/154
5,055,961 A 10/1991 Wiblin et al.
5,930,104 A * 7/1999 Kadah et al. ..... 361/187
6,493,204 B1 12/2002 Glidden et al.
6,600,239 B2 7/2003 Winick et al.

OTHER PUBLICATIONS

Declaration of sole inventor, Malcolm J. Critchley, pertaining to U.S. Appl. No. 12/431,682; Declaration dated May 4, 2009; 4 pages.
Declaration of an employee of Leach International Corporation, Randy Louwsma, pertaining to U.S. Appl. No. 12/431,682; Declaration dated May 15, 2009; 3 pages.

* cited by examiner

*Primary Examiner* — Dharti Patel
(74) *Attorney, Agent, or Firm* — Christie, Parker & Hale, LLP

(57) ABSTRACT

A system and method for quickly discharging an AC relay is provided. In one embodiment, the invention relates to a circuit for discharging a relay coil a relay, the circuit including relay circuitry having a relay coil disposed across a rectifier circuit, wherein the relay coil is configured to actuate at least one load switch when sufficiently energized, relay release circuitry including suppression circuitry coupled across the relay coil, and isolation circuitry in series between the relay coil and the rectifier circuit, and control circuitry configured to provide a voltage to the rectifier circuit to energize the relay coil, wherein the isolation circuitry is configured to isolate the relay coil and suppression circuitry based on a signal from the control circuitry.

25 Claims, 5 Drawing Sheets

SYSTEM AND METHOD FOR QUICKLY DISCHARGING AN AC RELAY

CROSS REFERENCE TO RELATED APPLICATIONS

The present application claims the benefit of Provisional Application No. 61/048,552, filed Apr. 28, 2008, entitled "SYSTEM AND METHOD FOR QUICKLY DISCHARGING AN AC RELAY", the entire content of which is incorporated herein by reference.

BACKGROUND TO THE INVENTION

The present invention relates generally to a system and method for quickly discharging an alternating current (AC) relay. More specifically, the present invention relates to a system for minimizing the amount of time expended in discharging a direct current (DC) relay coil charged using an AC power source.

Relay coils are inductors and oppose changes in current flow. DC coils are often used within an AC relay to generate a switching force capable of actuating one or more load switches. In such case, an AC voltage is rectified and then applied to the DC coils which store the applied energy and generate the switching force. Once a voltage or energy threshold has been met, load switches are actuated by the switching force of the DC coil. As the supply voltage to the coil is switched off, high voltage peaks are generated due to the inductance of the coil. Such high voltage peaks can damage control logic, power sources and switch contacts.

AC relays often include rectifier circuits, such as full wave or half wave rectifier circuits, that convert AC voltage to DC voltage which is used to charge DC coils. A full wave rectifier circuit generally includes four diodes in a bridge configuration. In such case, a DC coil is often coupled across the diode bridge. After the DC coil has been sufficiently charged as to provide the switching force, the AC supply voltage is removed. The energy stored in the DC coil is dissipated by the diodes over a period of time. However, the period of time needed to dissipate the energy stored in the DC coil can be substantial.

SUMMARY OF THE INVENTION

Aspects of the invention relate to a system and method for quickly discharging an AC relay. In one embodiment, the invention relates to a circuit for discharging a relay coil, the circuit including a power source configured to generate an alternating current signal for energizing the relay coil, a rectifier circuit coupled to the power source, the rectifier circuit having at least one diode, and a relay release circuit including a switch coupled to the rectifier circuit, the switch in series with the relay coil, where the relay coil is coupled to the rectifier circuit, and a suppression circuit coupled in parallel to the relay coil, the suppression circuit including a second diode in series with a zener diode, where the relay coil, when sufficiently energized, is configured to provide a switching force sufficient to actuate at least one load switch coupled to at least one switched power line, where the suppression circuit is configured to discharge the energy stored in the relay circuit, and where the rectifier circuit is configured to rectify the alternating current signal.

In another embodiment, the invention relates to a circuit for discharging a relay coil, the circuit including a relay circuit having the relay coil disposed across a rectifier circuit, where the relay coil is configured to actuate at least one load switch when sufficiently energized, a relay release circuit including a suppression circuit coupled across the relay coil, the suppression circuit including a zener diode in series with a diode, and an isolation circuit in series between the relay coil and the rectifier circuit, and a control circuit configured to provide an alternating current signal to the rectifier circuit to energize the relay coil, where the isolation circuit is configured to isolate the relay coil and the suppression circuit based on a signal from the control circuit, and where the rectifier circuit is configured to rectify the alternating current signal.

In yet another embodiment, the invention relates to a circuit for discharging a relay coil, the circuit including a power source configured to energize the relay coil, a rectifier circuit coupled to the power source, the rectifier circuit including at least one diode, a relay release circuit including a switch coupled to the rectifier circuit, the switch in series with the relay coil, where the relay coil is coupled to the rectifier circuit, and a suppression circuit coupled in parallel to the relay coil, the suppression circuit including a second diode in series with a zener diode, where the relay coil, when sufficiently energized, is configured to provide a switching force sufficient to actuate at least one load switch coupled to at least one switched power line, where the suppression circuit is configured to discharge the energy stored in the relay circuit, and where the rectifier circuit includes a bridge rectifier circuit including four diodes in a bridge configuration.

In still yet another embodiment, the invention relates to a circuit for discharging a relay coil, the circuit including a relay circuit including a relay coil disposed across a rectifier circuit, where the relay coil is configured to actuate at least one load switch when sufficiently energized, a relay release circuit including a suppression circuit coupled across the relay coil, the suppression circuit including a zener diode in series with a diode, and an isolation circuit in series between the relay coil and the rectifier circuit, and a control circuit configured to provide a voltage to the rectifier circuit to energize the relay coil, where the isolation circuit is configured to isolate the relay coil and suppression circuit based on a signal from the control circuit, and where the rectifier circuit includes a bridge rectifier circuit including four diodes in a bridge configuration.

In another embodiment, the invention relates to a circuit for discharging a relay coil, the circuit including a relay circuit including a relay coil disposed across a rectifier circuit, where the relay coil is configured to actuate at least one load switch when sufficiently energized, a relay release circuit including a suppression circuit coupled across the relay coil, and an isolation circuit in series between the relay coil and the rectifier circuit, and a control circuit configured to provide a voltage to the rectifier circuit to energize the relay coil, where the isolation circuit is configured to isolate the relay coil and suppression circuit based on a signal from the control circuit, where the isolation circuit is a MOSFET configured as a switch, and where a gate of the MOSFET is coupled to an RC circuit in series with a zener diode and a resistor, where the RC circuit, the zener diode and the resistor are coupled across the rectifier.

DETAILED DESCRIPTION OF THE INVENTION

Turning now to the drawings, embodiments of systems and methods for quickly discharging an AC relay are illustrated. The AC relays generally include DC coils that provide a switching force when sufficient voltage is applied by a rectifier circuit. Rectifier circuits convert energy from an AC control power source to DC. Fast release circuits coupled to the rectifier circuits isolate the DC coils and quickly dissipate the energy stored in the DC coils when the AC power source is switched off. In several embodiments, the fast release circuit includes a switch in series with the DC coil and a suppression circuit including a conventional diode and a zener diode in series, where the suppression circuit is coupled in parallel across the DC coil.

In some embodiments, the fast release circuits are used in conjunction with full wave bridge rectifier circuits. In other embodiments, the fast release circuits are used with half wave rectifier circuits. For the full wave bridge rectifier circuits, energy stored in the DC coil when the power is switched off can be dissipated via bridge diodes. However, the time period required for sufficient dissipation of the stored energy to change the position of relay armature, after the coil energizing voltage has been switched off, or release time, can be too long for some applications. In one embodiment, for example, a release time of 20 milliseconds (ms) or more is too long. Using the fast release circuit, the release time can be substantially reduced. In one embodiment, for example, the release time can be reduced to 10 ms or less. In some embodiments, the release time is reduced by 50 to 500 percent.

In one embodiment, the AC relays having a fast release circuit can be used to control the distribution of power in an aircraft electrical system. Power can be distributed using any of DC or AC (single, two or three phase) systems, or combinations thereof. In a number of embodiments, the AC relay has one load switch that switches a DC power source. In several embodiments, the DC power sources operate at 28 volts, 26 volts or 270 volts. In one embodiment, the DC power sources operate in the range of 11 to 28 volts. In other embodiments, the AC relay includes three load switches that switch different phases of an AC power source. In one embodiment, the AC power source operates at 115 volts and at a frequency of 400 hertz. In other embodiments, the AC relays having a fast release circuit have more than a single load switch, where each load switch can switch a DC power source or a single phase of an AC power source. In other embodiments, the power sources operate at other voltages and other frequencies. In one embodiment, the DC power sources can include batteries, auxiliary power units and/or external DC power sources. In one embodiment, the AC power sources can include generators, ram air turbines and/or external AC power sources.

Figure 1:
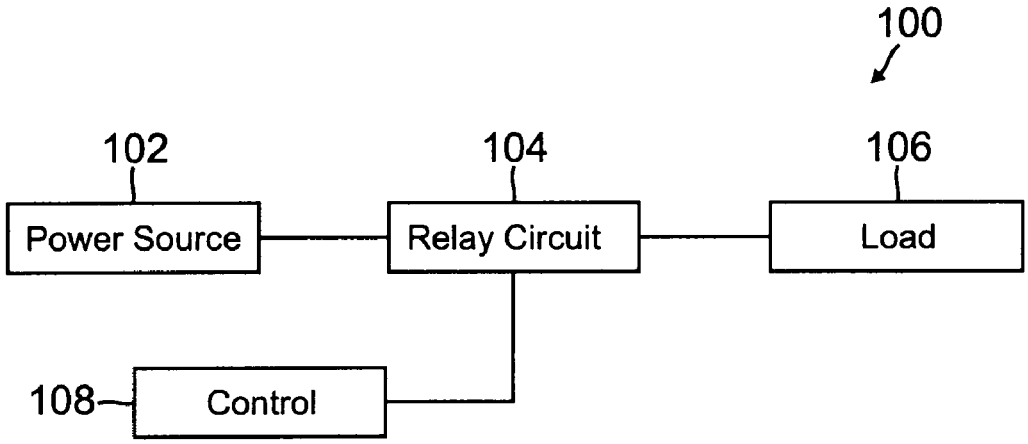
FIG. 1 is a schematic block diagram of a power control system including an AC relay circuit in accordance with an embodiment of the present invention.

FIG. 1 is a schematic block diagram of a power control system 100 including an AC relay circuit 104 in accordance with an embodiment of the present invention. The power control system 100 includes a power source 102 coupled to the relay circuit 104. The relay circuit 104 is also coupled to a load 106 and a control circuit 108.

In operation, the relay circuit 104 controls the flow of current from the power source 102 to the load 106 based on input received from the control circuit 108. In one embodiment, the power source is an AC power source used in an aircraft. In such case, the load is an aircraft load such as, for example, aircraft lighting or aircraft heating and cooling systems.

In several embodiments, the relay circuit 104 includes a DC coil and a fast release circuit. The fast release circuit can isolate the DC coil and quickly dissipate the energy stored in the DC coil when power provided by the control circuit 108 is switched off or removed.

Figure 2:
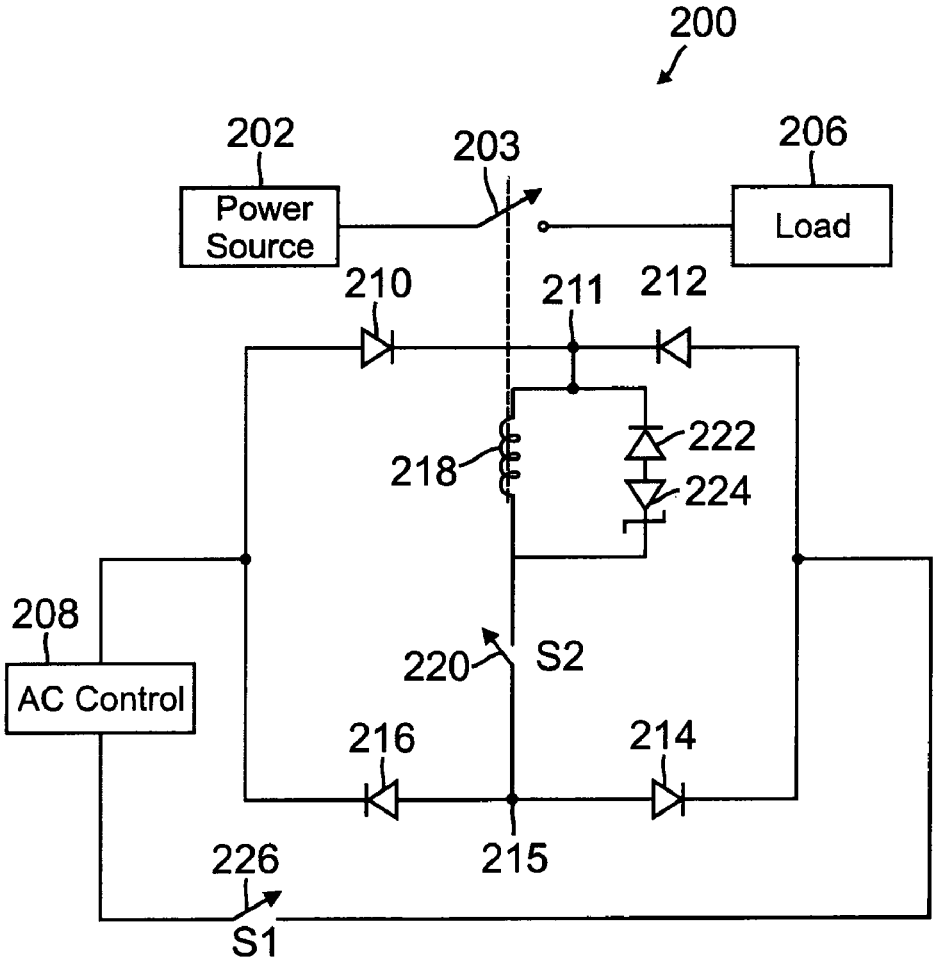
FIG. 2 is a schematic diagram of an AC relay circuit including a full wave rectifier and a fast release circuit in accordance with an embodiment of the present invention.

FIG. 2 is a schematic diagram of an AC relay circuit 200 including a full wave rectifier circuit and a fast release circuit in accordance with an embodiment of the present invention. The AC relay circuit further includes a power source 202 coupled with a load switch 203. The position of the load switch 203 is controlled by a switching force generated in a DC coil 218. The load switch 203 is also coupled to a load 206.

An AC control power source 208 is coupled by a first switch 226 to the full wave rectifier. The full wave rectifier includes four diodes (210, 212, 214 and 216) in a diode bridge rectifier configuration. Diodes 210 and 216 are coupled to AC control 208. Diodes 212 and 214 are coupled to the AC control 208 via switch 226. The cathodes of diode 210 and diode 212 are coupled by a node 211. The anodes of diode 214 and diode 216 are coupled by a node 215. A fast release control switch 220 and the DC coil 218 are coupled in series across the diode bridge, or between node 211 and node 215. A diode 222 and a zener diode 224 are coupled in a back to back configuration, e.g., where the anodes of both diodes are coupled together, in parallel to the DC coil 218. In another embodiment, the cathodes of diode 222 and zener diode 224 are coupled together. In one embodiment, the control switch 220, diode 222, zener diode 224 and DC coil 218 form a fast release circuit.

Figure 3:
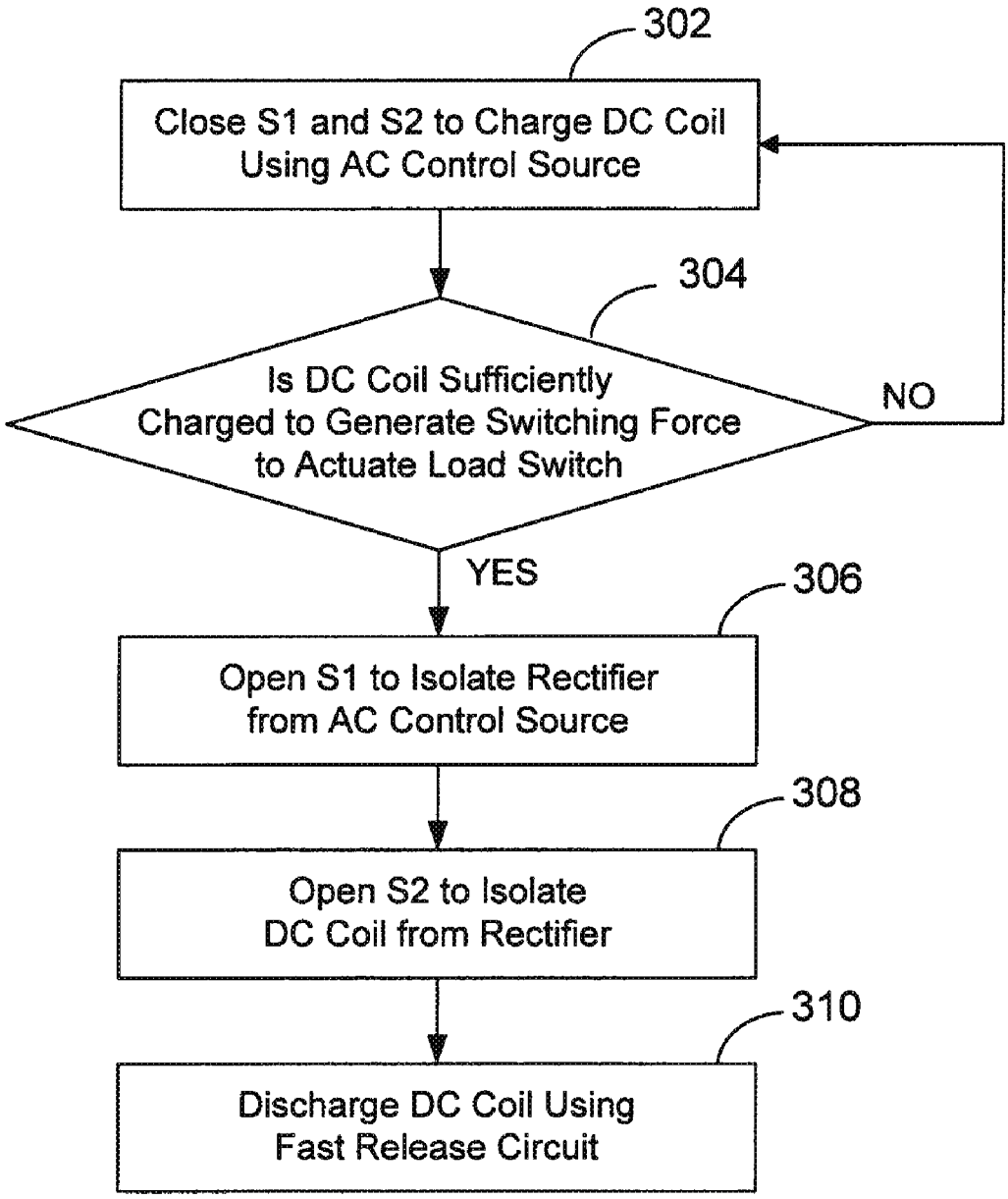
FIG. 3 is a flow chart of a process for operating an AC relay circuit having a fast release circuit in accordance with an embodiment of the present invention.

FIG. 3 is a flow chart of a process for operating an AC relay circuit having a fast release circuit in accordance with an embodiment of the present invention. In particular embodiments, the process is performed in conjunction with the fast release circuit of FIG. 2. In block 302, the process begins by closing switch S1 and switch S2 to charge the DC coil using the AC control source. In block 304, the process determines whether the DC coil has been sufficiently charged as to generate the switching force necessary to actuate the load switch. If the DC coil has not been sufficiently charged, then the process returns to block 302 and continues to charge the DC coil. If the DC coil has been sufficiently charged, then the process continues to block 306. In block 306, the process opens switch S1 which isolates the rectifier from the AC control source. In block 308, the process opens switch S2 to isolate the DC coil from the rectifier. In a number of embodiments, a back voltage or back electromotive force (EMF) is generated by the DC coil in response to the sudden loss of current supplied by the AC control source. In block 310, the process discharges energy stored in the DC coil (e.g., the back voltage) using the fast release circuit.

In the embodiment illustrated in FIG. 2, the fast release circuit includes diode 222 and zener diode 224 in the back to back configuration. In several embodiments, if the back EMF generated in the DC coil is greater than the breakdown voltage of the zener diode, the zener diode operates in a reverse biased mode and permits a controlled amount of current to flow through the zener diode and thus through the conventional diode. In such case, both diodes dissipate energy as current flows through both diodes and returns to the DC coil. This dissipation cycle can repeat until the DC coil is fully discharged. In some embodiments, the DC coil is discharged in a single cycle. In several embodiments, the value of the zener diode, the zener or breakdown voltage, is chosen to enable a particular release time. For example, in one embodiment, a 200 volt zener diode enables a release time of less than 10 ms.

In one embodiment, the process can perform the illustrated actions in any order. In another embodiment, the process can omit one or more of the actions. In some embodiments, the process performs additional actions in conjunction with the process. In other embodiments, one of more of the actions are performed simultaneously.

Figure 3A:
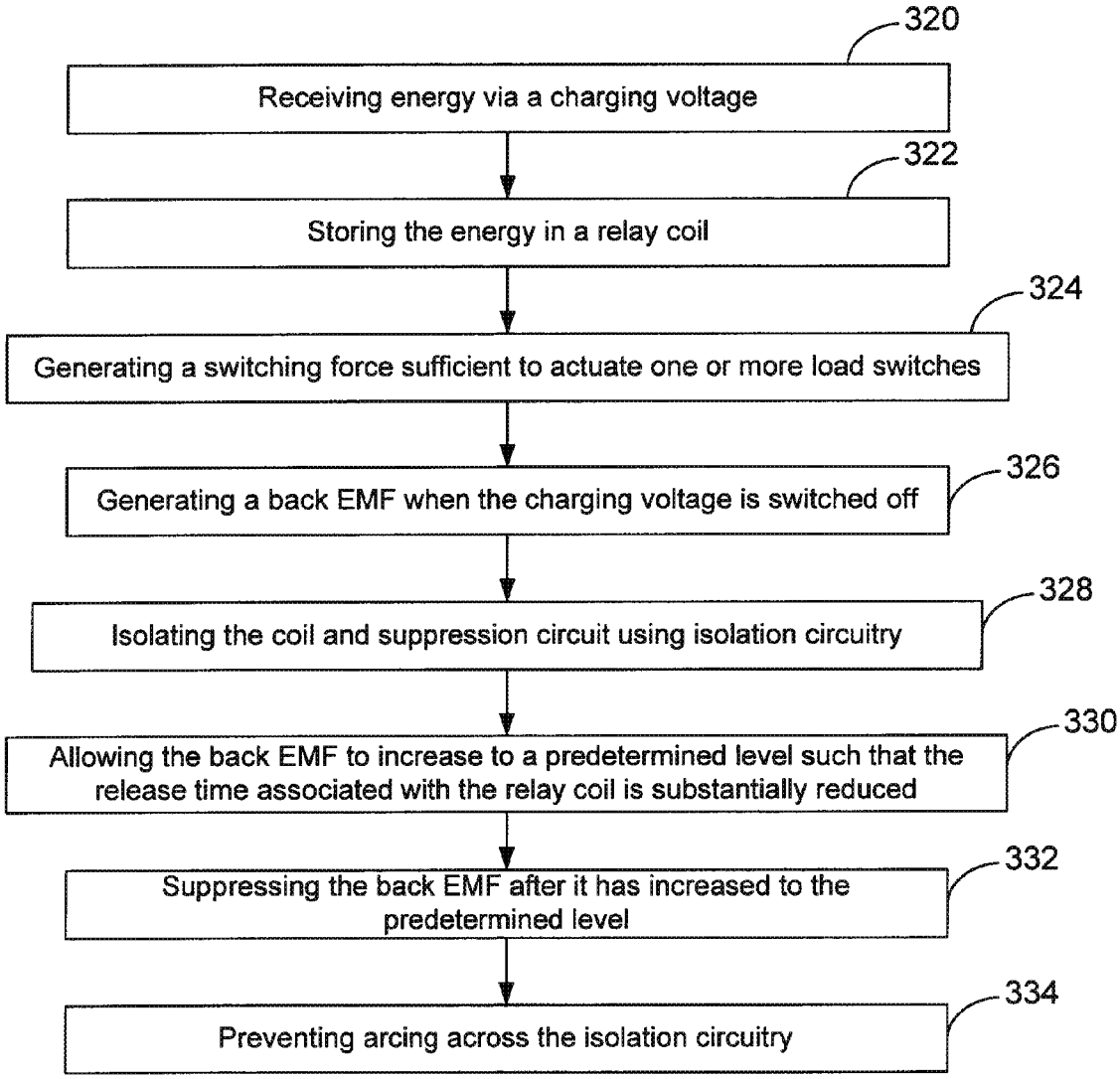
FIG. 3*a* is a flow chart of a sequence of actions performed by an AC relay circuit having a fast release circuit in accordance with an embodiment of the present invention.

FIG. 3*a* is a flow chart of a sequence of actions performed by an AC relay circuit having a fast release circuit in accordance with an embodiment of the present invention. In particular embodiments, the process is performed in conjunction with the fast release circuit of FIG. 2. In block 320, the circuit begins by receiving energy via a charging voltage. In one embodiment, the charging voltage is provided by an AC control source. In block 322, the circuit stores the received energy in a relay coil. In block 324, the circuit generates a switching force sufficient to actuate one or more load switches. In block 326, the circuit generates a back EMF when the charging voltage is switched off. In several embodiments, the relay coil generates the back EMF.

In block 328, the circuit isolates the relay coil and the suppression circuit using isolation circuitry. In block 330, the circuit allows the back EMF to increase to a predetermined level such that the release time associated with the relay coil is substantially reduced. In some embodiments, circuit decreases the release time for the AC relay by 50 percent to 500 percent. In block 332, the circuit suppresses the back EMF after it has increased to the predetermined level. In one embodiment, the predetermined level is 200 volts. In block 334, the circuit prevents arcing across the isolation circuitry. In one embodiment, the suppression circuit includes a conventional diode in series with a zener diode. In several embodiments, the value, or breakthrough voltage, of the zener diode is selected such that it is less than an arcing voltage across the isolation circuitry. In such case, the zener diode will conduct before arcing across the isolation circuitry can take place.

In one embodiment, the circuit can perform the illustrated actions in any order. In another embodiment, the circuit can omit one or more of the actions. In some embodiments, the circuit performs additional actions. In other embodiments, one of more of the actions are performed simultaneously.

Figure 4:
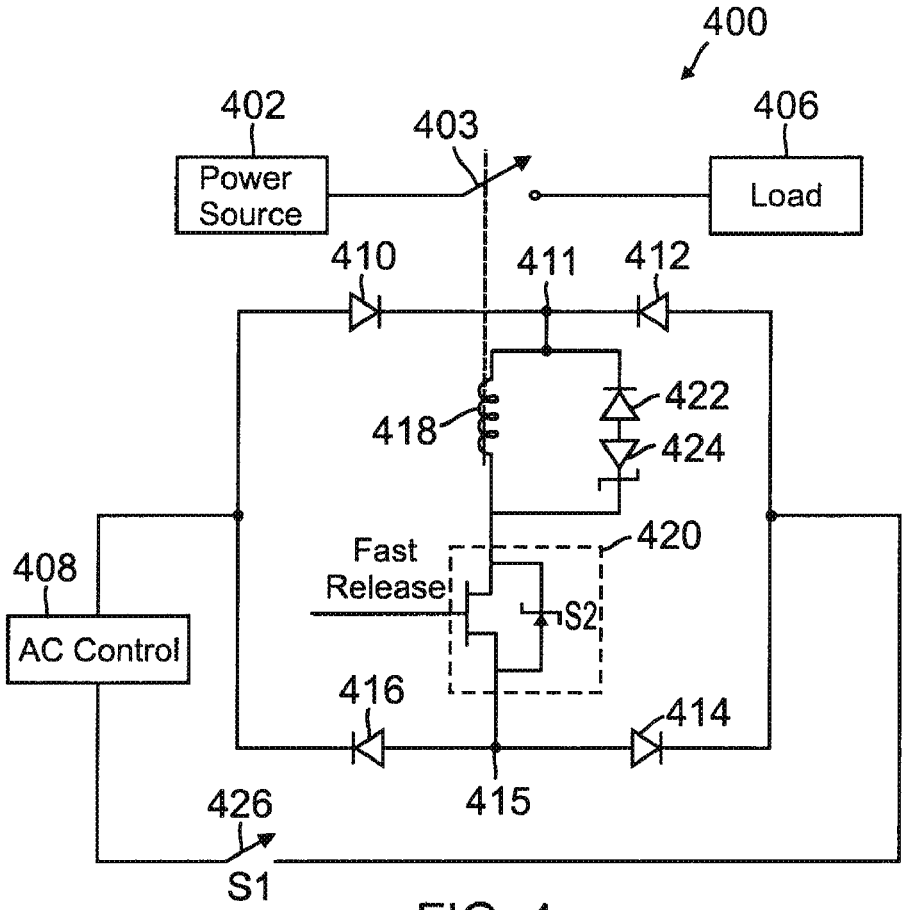
FIG. 4 is a schematic diagram of an AC relay circuit including a full wave rectifier and a fast release circuit in accordance with an embodiment of the present invention.

FIG. 4 is a schematic diagram of an AC relay circuit 400 including a full wave rectifier and a fast release circuit in accordance with an embodiment of the present invention. The AC relay circuit 400 further includes a power source 402 coupled with a load switch 403. The position of the load switch 403 (e.g., position of armature of the load switch) is controlled by a switching force generated in a DC coil 418. The load switch 403 is also coupled to a load 406.

An AC control power source 408 is coupled by a first switch 426 to the full wave rectifier. The full wave rectifier includes four diodes (410, 412, 414 and 416) in a diode bridge rectifier configuration. Diodes 410 and 416 are coupled to AC control 408. Diodes 412 and 414 are coupled to the AC control 408 via switch 426. The cathodes of diode 410 and diode 412 are coupled by a node 411. The anodes of diode 414 and diode 416 are coupled by a node 415. A fast release control switch 420, implemented here using a metal oxide semiconductor field effect transistor (MOSFET), and the DC coil 418 are coupled in series across the diode bridge, or between node 411 and node 415. A diode 422 and a zener diode 424 are coupled in a back to back configuration, e.g., where the anodes of both diodes are coupled together, in parallel to the DC coil 418. In another embodiment, the cathodes of diode 422 and zener diode 424 are coupled together.

In several embodiments, the control switch 420, diode 422, zener diode 424, and DC coil 418 form a fast release circuit. In one embodiment, the value or breakdown voltage of the zener diode is selected such that it is just lower than the breakthrough voltage of the parasitic diode of the MOSFET switch 420. In such case, circuit operates such that the zener diode conducts before the MOSFET switch allows reverse conduction. In other embodiments, the value of the zener diode can be chosen based on other circuit characteristics. In some embodiments, the value of the zener diode is selected such that arcing between switch contacts is prevented.

In some embodiments, while the back EMF of the DC coil is greater than the breakdown voltage of the zener diode, the zener diode operates in a reverse biased mode and permits a controlled amount of current to flow through the zener diode and thus through the conventional diode. In such case, both diodes dissipate energy as current flows through both diodes and returns to the DC coil. This dissipation cycle can repeat until the DC coil is fully discharged. In several embodiments, the value of the zener diode, the zener or breakdown voltage, and the characteristics of the MOSFET (e.g., value of breakthrough voltage of the parasitic diode) are chosen to enable a particular release time. For example, in one embodiment, a zener diode having a breakdown voltage of 200 volts enables a release time of less than 10 ms. In such case, a MOSFET having a breakthrough voltage of the parasitic diode of greater than 200 volts can be used. In one embodiment, for example, the breakthrough voltage for the parasitic diode is 500 V. In another embodiment, a separate zener diode is used instead of the depicted parasitic (zener) diode in a parallel configuration across the MOSFET 420.

Figure 5:
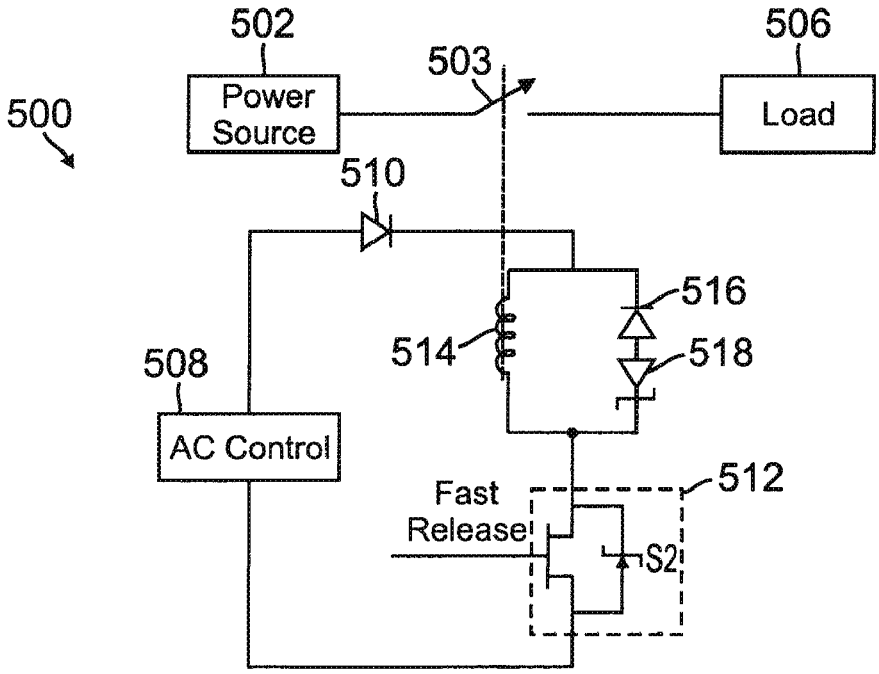
FIG. 5 is a schematic diagram of an AC relay circuit including a half wave rectifier and a fast release circuit in accordance with an embodiment of the present invention.

FIG. 5 is a schematic diagram of an AC relay circuit 500 including a half wave rectifier and a fast release circuit in accordance with an embodiment of the present invention. The AC relay circuit 500 further includes a power source 502 coupled to a load switch 503. The position of the armature of the load switch 503 is controlled by a switching force generated in a DC coil 514. The load switch 503 is also coupled to a load 506.

An AC control power source 508 is coupled by a half wave rectifier diode 510 to the DC coil 514. The AC control power source 508 is also coupled by a MOSFET switch 512 to the DC coil 514. A diode 516 and a zener diode 518 are coupled in a back to back series configuration, e.g., where the anodes of both diodes are coupled together, across (e.g., in parallel to) the DC coil 514. In an alternative embodiment, the cathodes of diode 516 and zener diode 518 are coupled together.

In operation, the AC relay circuit 500 can operate as described in FIG. 3. In several embodiments, the control switch 512, diode 516, zener diode 518 and DC coil 514 form a fast release circuit. In one embodiment, the value or breakdown voltage of the zener diode is selected such that it is lower than the breakthrough voltage of the parasitic diode of the MOSFET switch 512. In such case, circuit operates such that the zener diode conducts before the MOSFET switch allows reverse conduction. In such case, arcing across the MOSFET switch is prevented. In other embodiments, the value of the zener diode can be chosen based on other circuit characteristics. In a number of embodiments, the value of the zener diode is selected such that arcing between switch contacts is prevented.

In some embodiments, while the back EMF of the DC coil is greater than the breakdown voltage of the zener diode, the zener diode operates in a reverse biased mode and permits a controlled amount of current to flow through the zener diode and the conventional diode. In such case, both diodes dissipate energy as current flows through both diodes and returns to the DC coil. This dissipation cycle can repeat until the DC coil is fully discharged.

In some embodiments, the DC coil is discharged in a single cycle. In several embodiments, the value of the zener diode, the zener or breakdown voltage, and the characteristics of the MOSFET (e.g., value of breakthrough voltage of the parasitic diode) are chosen to enable a particular release time. For example, in one embodiment, a zener diode having a breakdown voltage of 200 volts enables a release time of less than 10 ms. In such case, a MOSFET having a breakthrough voltage for the parasitic diode of greater than 200 volts can be used. In one embodiment, for example, the breakthrough voltage of the parasitic diode is 500 V. In another embodiment, a separate zener diode is used instead of the depicted parasitic (zener) diode. In such case, the separate zener diode can improve MOSFET switch response to back EMFs and/or protect circuitry from other surges (e.g., lightning).

In some embodiments, the fast release circuit decreases the release time for the AC relay by 50 percent to 500 percent. In such case, the AC relay having a fast release circuit operates anywhere from 50 to 500 percent faster than a conventional AC relay.

Figure 6:
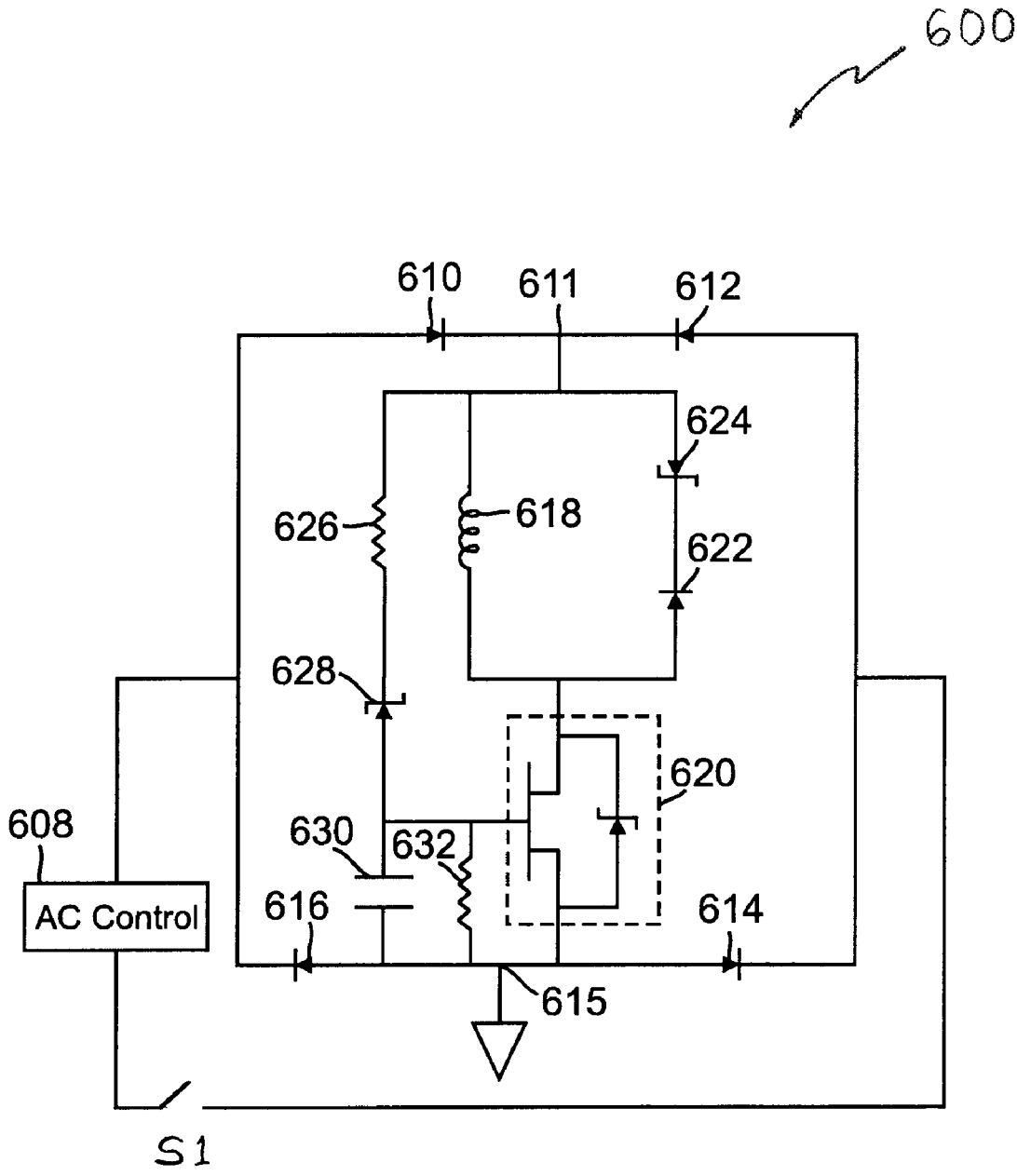
FIG. 6 is a schematic diagram of an AC relay circuit including a full wave rectifier and a fast release circuit in accordance with an embodiment of the present invention.

FIG. 6 is a schematic diagram of an AC relay circuit 600 including a full wave rectifier and a fast release circuit in accordance with an embodiment of the present invention. The AC relay circuit 600 includes an AC control source 608 coupled to a diode bridge rectifier having a fast release circuit including a DC coil coupled across the diode bridge rectifier. The diode bridge rectifier includes four diodes (610, 612, 614 and 616) in a diode bridge rectifier configuration. Diodes 610 and 616 are coupled to AC control 608. Diodes 612 and 614 are coupled to the AC control 608. The cathodes of diode 610 and diode 612 are coupled by a node 611. The anodes of diode 614 and diode 616 are coupled by a node 615.

A fast release control switch 620, implemented here using MOSFET, and the DC coil 618 are coupled in series across the diode bridge, or between node 611 and node 615. A diode 622 and a zener diode 624 are coupled in a front to front configuration, (e.g., where the cathodes of both diodes are coupled is series together), across the DC coil 618. In another embodiment, the anodes of diode 622 and zener diode 624 are coupled together. A resistor 626 is coupled to node 611 and a cathode of a second zener diode 628. The anode of the zener diode 628 is coupled to the gate of the MOSFET switch 620, to a capacitor 630, and to a resistor 632. The capacitor 630 and the resistor 632 are also coupled to node 615 which is coupled to a ground. In the illustrated embodiment, a drain of MOSFET switch 620 is coupled to diode 622 and DC coil 618. A source of MOSFET switch 620 is coupled to node 615. In the illustrated embodiment, the MOSFET switch 620 includes a body zener diode, or inherent diode, having a cathode coupled to the drain and an anode coupled to the source. In other embodiments, a separate zener diode is coupled in a similar polarity across the drain and source of the MOSFET switch 620.

In several embodiments, the values for resistor 626, zener diode 628, capacitor 630 and resistor 632 are chosen such that MOSFET switch 620 is turned on at approximately the same time as that the voltage applied to DC coil 618 reaches a level appropriate for the DC coil to generate the switching force sufficient to actuate the armature of the relay (not shown). In such case, the MOSFET switch 620 opens and isolates the DC coil 618 and transient suppression components (zener diode 624 and diode 622). The RC circuit including capacitor 630 and resistor 632 maintain the gate voltage of the MOSFET switch 620 for a period of time sufficient to allow the transient suppression components to fully discharge the DC coil. In several embodiments, zener diode 624 has a relatively high breakdown voltage such that a large back EMF is generated and quickly dissipated. In such case, the release time for the DC coil is substantially decreased as compared to a conventional relay.

In one embodiment, zener diode 624 has a breakdown voltage of 200 volts while zener diode 628 has a breakdown voltage of 12 volts. In other embodiments, zener diodes having different breakdown voltages can be used.

In a number of embodiments, additional characteristics of an AC relay having a fast release circuit are designed to accommodate a particular intended back EMF. For example, in several embodiments, the separation of traces on a printed circuit board of the AC relay is implemented such that arcing between traces at the intended back EMF is prevented. In other embodiments, the material and thickness of coating(s) applied to the DC coil are selected such that arcing between windings at the intended back EMF and/or damage to coatings based on the magnitude of the back EMF are prevented.

While the above description contains many specific embodiments of the invention, these should not be construed as limitations on the scope of the invention, but rather as examples of specific embodiments thereof. Accordingly, the scope of the invention should be determined not by the embodiments illustrated, but by the appended claims and their equivalents.

What is claimed is:

1. A circuit for discharging a relay coil, the circuit comprising:

a power source configured to generate an alternating current signal for energizing the relay coil;

a rectifier circuit coupled to the power source, the rectifier circuit comprising at least one diode; and a relay release circuit comprising:

a switch coupled to the rectifier circuit, the switch in series with the relay coil, wherein the relay coil is coupled to the rectifier circuit; and a suppression circuit coupled in parallel to the relay coil, the suppression circuit comprising a second diode in series with a zener diode, wherein the relay coil, when sufficiently energized, is configured to provide a switching force sufficient to actuate at least one load switch coupled to at least one switched power line, wherein the suppression circuit is configured to discharge the energy stored in the relay circuit, and wherein the rectifier circuit is configured to rectify the alternating current signal.

2. The circuit of claim 1:

wherein the switch has a pre-selected voltage limit; and wherein the zener diode has a breakdown voltage less than the voltage limit of the switch.

3. The circuit of claim 2, wherein a voltage applied to the switch less than the voltage limit does not cause arcing across the switch.

4. The circuit of claim 2, wherein the switch is a MOSFET switch.

5. The circuit of claim 4, wherein the pre-selected voltage limit of the MOSFET switch is based on a characteristic of a body diode of the MOSFET switch.

6. The circuit of claim 1, wherein an anode of the second diode is coupled to an anode of the zener diode.

7. The circuit of claim 1, wherein a cathode of the second diode is coupled to a cathode of the zener diode.

8. The circuit of claim 1, the switch is configured to isolate the relay coil and the suppression circuit from the rectifier circuit.

9. The circuit of claim 1, wherein the at least one load switch is configured to control a flow of current between a second power source and a load.

10. The circuit of claim 1:

wherein, when the switch is in a first position, the suppression circuit is configured to discharge the energy stored in the relay circuit within a first preselected release time, wherein, when the switch is in a second position, the rectifier circuit is configured to discharge the energy stored in the relay circuit within a second preselected release time, and wherein the first preselected release time is less than the second preselected release time.

11. The circuit of claim 10, wherein the first position is an open position and the second position is a closed position.

12. A circuit for discharging a relay coil, the circuit comprising:

a power source configured to energize the relay coil;

a rectifier circuit coupled to the power source, the rectifier circuit comprising at least one diode;

a relay release circuit comprising:

a switch coupled to the rectifier circuit, the switch in series with the relay coil, wherein the relay coil is coupled to the rectifier circuit; and a suppression circuit coupled in parallel to the relay coil, the suppression circuit comprising a second diode in series with a zener diode, wherein the relay coil, when sufficiently energized, is configured to provide a switching force sufficient to actuate at least one load switch coupled to at least one switched power line, wherein the suppression circuit is configured to discharge the energy stored in the relay circuit, and wherein the rectifier circuit comprises a bridge rectifier circuit including four diodes in a bridge configuration.

13. A circuit for discharging a relay coil, the circuit comprising:

a relay circuit comprising a relay coil disposed across a rectifier circuit, wherein the relay coil is configured to actuate at least one load switch when sufficiently energized;

a relay release circuit comprising:

a suppression circuit coupled across the relay coil, the suppression circuit comprising a zener diode in series with a diode; and an isolation circuit in series between the relay coil and the rectifier circuit; and a control circuit configured to provide an alternating current signal to the rectifier circuit to energize the relay coil, wherein the isolation circuit is configured to isolate the relay coil and suppression circuit based on a signal from the control circuit, and wherein the rectifier circuit is configured to rectify the alternating current signal.

14. The circuit of claim 13, wherein the suppression circuit is configured to dissipate energy stored in the relay coil.

15. The circuit of claim 13, wherein the relay circuit is configured to release the load switch when sufficient energy is dissipated from the relay coil.

16. The circuit of claim 13, wherein the relay release circuit is configured to minimize a release time of a relay, comprising the relay coil.

17. The circuit of claim 13, wherein the isolation circuit is a switch.

18. The circuit of claim 17:

wherein the switch has a pre-selected voltage limit;

wherein the suppression circuit comprises a zener diode in series with a diode; and wherein a breakdown voltage of the zener diode is less than the voltage limit of the switch.

19. The circuit of claim 17, wherein the switch is a MOSFET.

20. The circuit of claim 13, wherein the isolation circuit is configured to isolate the relay coil and the suppression circuit from the rectifier circuit.

21. The circuit of claim 13, wherein the at least one load switch is configured to control a flow of current between a second power source and a load.

22. The circuit of claim 13:

wherein the isolation circuit is a switch, wherein, when the switch is in a first position, the suppression circuit is configured to discharge the energy stored in the relay circuit within a first preselected release time, wherein, when the switch is in a second position, the rectifier circuit is configured to discharge the energy stored in the relay circuit within a second preselected release time, and wherein the first preselected release time is less than the second preselected release time.

23. The circuit of claim 22, wherein the first position is an open position and the second position is a closed position.

24. A circuit for discharging a relay coil, the circuit comprising:

a relay circuit comprising a relay coil disposed across a rectifier circuit, wherein the relay coil is configured to actuate at least one load switch when sufficiently energized;

a relay release circuit comprising:

a suppression circuit coupled across the relay coil, the suppression circuit comprising a zener diode in series with a diode; and an isolation circuit in series between the relay coil and the rectifier circuit; and a control circuit configured to provide a voltage to the rectifier circuit to energize the relay coil, wherein the isolation circuit is configured to isolate the relay coil and suppression circuit based on a signal from the control circuit, and wherein the rectifier circuit comprises a bridge rectifier circuit including four diodes in a bridge configuration.

25. A circuit for discharging a relay coil, the circuit comprising:

a relay circuit comprising a relay coil disposed across a rectifier circuit, wherein the relay coil is configured to actuate at least one load switch when sufficiently energized;

a relay release circuit comprising:

a suppression circuit coupled across the relay coil; and an isolation circuit in series between the relay coil and the rectifier circuit; and a control circuit configured to provide a voltage to the rectifier circuit to energize the relay coil, wherein the isolation circuit is configured to isolate the relay coil and suppression circuit based on a signal from the control circuit, wherein the isolation circuit is a MOSFET configured as a switch, and wherein a gate of the MOSFET is coupled to an RC circuit in series with a zener diode and a resistor, wherein the RC circuit, the zener diode and the resistor are coupled across the rectifier.

* * * * *

UNITED STATES PATENT AND TRADEMARK OFFICE

CERTIFICATE OF CORRECTION

PATENT NO. : 8,116,059 B2
APPLICATION NO. : 12/431682
DATED : February 14, 2012
INVENTOR(S) : Malcolm J. Critchley It is certified that error appears in the above-identified patent and that said Letters Patent is hereby corrected as shown below:

On the Title Page

(57) Abstract, line 3. After "coil"
Delete "a relay"

In the Claims

Column 9, Claim 8, line 13. Before "the switch"
Insert -- wherein --

Signed and Sealed this
Fourth Day of September, 2012

David J. Kappos
*Director of the United States Patent and Trademark Office*